US005561409A

United States Patent [19]

Rapp et al.

[11] Patent Number: 5,561,409

[45] Date of Patent: Oct. 1, 1996

[54] HOLDER FOR AN ELECTRICAL SAFETY FUSE

[75] Inventors: Lothar Rapp, Munich; Claus-Peter Heitzig, Pfaffenhofen, both of Germany

[73] Assignee: Siemens Aktiengesellschaft, Munich, Germany

[21] Appl. No.: 404,447

[22] Filed: Mar. 15, 1995

[30] Foreign Application Priority Data

Mar. 28, 1994 [DE] Germany ..... 9405264 U

[51] Int. Cl.[6] ..... H01H 85/02; H01R 33/95

[52] U.S. Cl. ..... 337/186; 439/621; 361/104

[58] Field of Search ..... 337/186, 187, 337/194, 195; 361/103–104; 439/250, 621–622

[56] References Cited

U.S. PATENT DOCUMENTS 4,762,509 8/1988 Schaefer ..... 439/621

5,023,588 6/1991 Heitzig et al. .

5,082,458 1/1992 Poerschke ..... 439/621

*Primary Examiner*—Leo P. Picard

*Assistant Examiner*—Jayprakash N. Gandhi

*Attorney, Agent, or Firm*—Hill, Steadman & Simpson

[57] ABSTRACT

A holder is provided for a cylindrical electrical safety fuse having conductive end caps. A hollow housing receives the fuse therein through a front side which is closeable with a closure cap. A compression spring at a back end of the housing biases the fuse against a conductive metal inner cap disposed interiorly of the end cap. The inner cap has a radially extending contact tab. A terminal pin is provided to conductively engage the contact tab. The terminal pin has a contact portion with a perpendicularly-extending base, a cantilevered front leg extending from and overlying the base, and a cantilevered spring leg extending from a second end of the base so that the spring leg is disposed intermediately between the front leg and the base and also overlies the base. A clamp slot is defined between the front leg and the spring leg to form an electrical contact with the contact tab.

3 Claims, 1 Drawing Sheet

HOLDER FOR AN ELECTRICAL SAFETY FUSE

BACKGROUND OF THE INVENTION

The invention is generally directed to a holder for an electrical safety fuse. More specifically, the present invention relates to such a holder for a cylindrical fuse having contact caps at its ends that are resiliently clamped between a closure cap at one end and a coil compression spring at the opposite end inside of a tubular housing.

Generally, fuse holders are known in which the fuse is accessed by a twist-off removable closure cap. The closure cap has a conductive portion which electrically contacts an end of the fuse. This contact portion has a contact tab which engages a contact pin to form an electrical outlet connection. Known fuse holders also have a compression spring within the tubular housing to bias against the fuse. The compression spring is connected to a terminal pin that projects from the holder to connect to an incoming line. When assembling such a fuse holder, the closure cap is pressed downward against the compression spring force, then rotated to cause the contact tab to slide into a slot in the manner of a bayonet-type closure.

In conventional fuse holders, there is a risk, however, that the contact tab will lift off from an associated recess in the cap, for example, by inadvertent pressure on the closure cap, resulting in an interruption of the current flowing across the fuse. Another problem with prior art holders is that portion of the contact pin which engages the contact tab can torsionally deflect in an undesirable manner, decreasing the integrity of electrical contact with the tab.

For simplifying the structural outlay and for eliminating these problems, it has been proposed to provide the contact pin with two tangentially extending clamp legs at its front side, these forming a rigid clamp slot for the contact tab that is turned thereinto. Due to tolerance in the width of the clamp slot and in the thickness of the contact tab, one must thereby count on too great a scatter in the clamping power. There is thus the risk that the contact tab is introduced with play relative to the clamp legs or that the clamping power is so high that damage occurs, rendering free introduction impossible.

SUMMARY OF THE INVENTION

The object of the invention is to assure a reliable contacting between the closure cap and the contact pin under all operating conditions.

To this end, in an embodiment, the present invention provides a holder for an electrical fuse, the type which is cylindrical and has conductive caps on opposite ends of the fuse. The holder also has a tubular housing within which the fuse generally resides. The housing has a front side and a back side, the front side being open to receive the fuse. The holder also has a closure cap which is securable to the front side of the housing to retain the fuse. The closure cap has an inner metal cap for contacting the frontmost cap of the fuse, the inner cap having a radially extending contact tab. A compression spring is disposed in the back of the housing to contact a backmost cap of the fuse. The spring is in compression between the housing and the fuse, biasing the frontmost end of the fuse against the conductive inner cap. A first terminal pin is electrically connected to the spring. A second terminal pin is electrically connected to the contact tab, the second terminal pin being disposed in the housing and having a portion extending from the back side of the housing. Furthermore, the second terminal pin has a contact portion located proximal to the closure cap configured to releasably engage the tab. The contact portion is generally G-shaped, having a generally perpendicularly-extending base portion. A cantilevered front leg extends from a first end of the base portion and overlies the base portion. A cantilevered spring leg extends from a second end of the base portion and is disposed intermediately between the front leg and the base portion, the spring leg also overlying the base. A clamp slot is defined between the front leg and the spring leg. This slot is dimensioned slightly smaller than the contact tab to receive the contact tab and form an electrical connection therewith. The spring leg is deflectable to provide a reliable contact with the tab. The tab is reliably contacted on two sides-on a front side by the front leg and on a rear side by the spring leg.

In an embodiment of the present invention, the spring leg is tapered in shape to form a lead-in or entry bevel for the contact tab.

In an embodiment of the present invention, the terminal pin is narrowed in shape, approximately one-half its general thickness in a region between the base portion and the front leg. This allows more space to provide a longer spring leg, improving its spring characteristics.

In accord therewith, the contact tab is resiliently clamped between the legs. A reliable contacting is thereby assured even given a tolerance deviation in the assembly dimensions. Providing the contact portion as a G-shaped member, the spring paths of the spring leg and of the retainer leg are such that the closure cap can be pressed in up to a detent without exceeding the elasticity limit of the formed member. When the closure cap is inadvertently pressed from the exterior, the contact tab can lift off from the rigid supporting first leg. When this occurs, however, an even more reliable contacting to the spring leg ensues as the spring leg resiliently follows the tab and springs back into its normally biased position when pressure against the closure cap is released.

According to an advantageous embodiment of the invention, the spring leg for the contact tab includes a lead-in bevel that extends down to a point below the rigid supporting leg. When the closure cap is pressed in, the contact tab is first moved past the shorter supporting leg until it is seated against the formed member. The lead-in bevel assures that the contact tab already proceeds to a point under the supporting leg before it touches the latter.

It is, therefore, an advantage of the present invention is to provide a fuse holder having reliable contacting between a cap contact and a terminal pin.

A further advantage of the present invention is to provide a fuse holder having a contact arrangement with improved resilient contacting.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
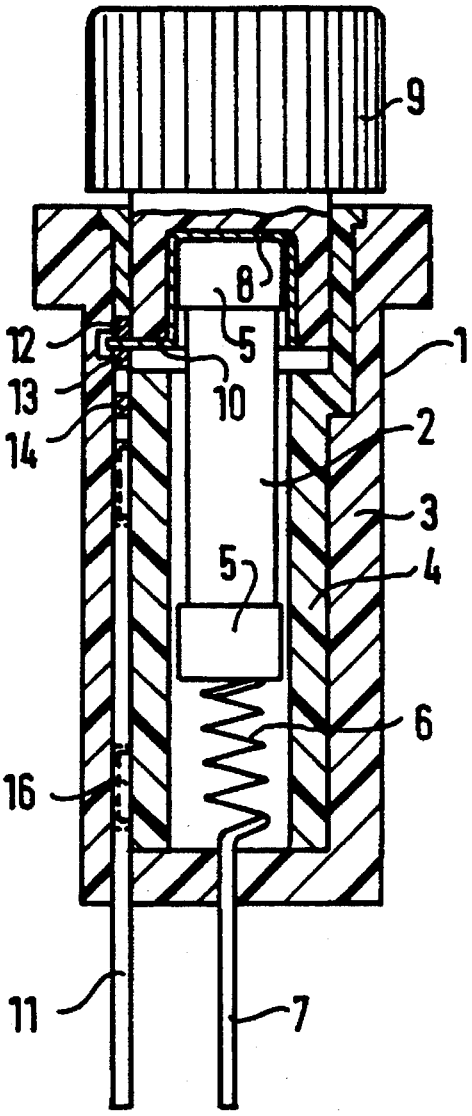
FIG. 1 illustrates a longitudinal section through a holder for a safety fuse.
Figure 2:
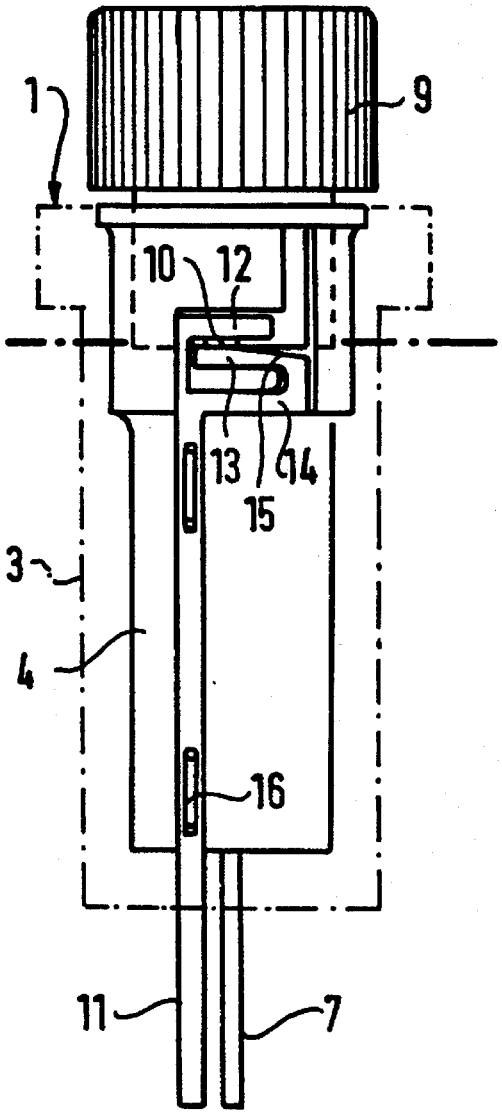
FIG. 2 illustrates a side view of the holder of FIG. 1.
Figure 3:
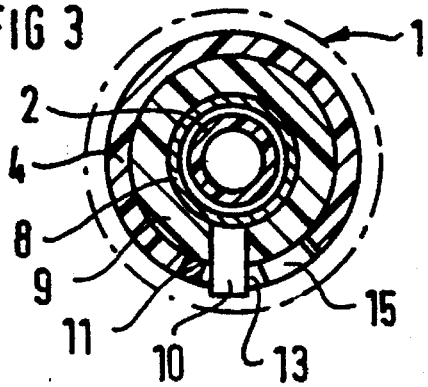
FIG. 3 illustrates a cross-section through the holder taken generally along line III—III in FIG. 2.

According to FIGS. 1, 2 and 3, a holder I for a cylindrical, electrical safety fuse 2 is composed of a hollow cylindrical outer housing 3 and of an essentially hollow cylindrical inner housing 4 that is plugged into the outer housing 3. As shown in FIGS. 1 and 3, the safety fuse 2 resides inside the inner housing 4. The fuse 2 is provided with conductive contact caps 5 at its end faces, as illustrated in FIG. 1. A coil compression spring 6 is arranged at a back side of the safety fuse 2. The coil compression spring 6 is connected to a terminal pin 7 which can be used as an incoming line. As a result of the coil compression spring 6, the safety fuse 2 has its frontmost end-face contact cap 5 conductively contacted or pressed against a metal inner cap 8 secured in a closure cap 9 at the front side.

The closure cap 9 is removable in a twist-off manner to allow replacement of the fuse 2. The closure cap 9 is securable over the open front side of the tubular housing 3 to retain the fuse 2. The inner metal cap 8 comprises a laterally radially projecting contact tab 10 that conductively contacts a contact pin 11 which has a back, projecting terminal portion extending from the housing 3 that can be used as an outgoing line.

As shown in FIGS. 1 and 2, at its front side, the contact pin 11 is fashioned as a cooperating contact portion for conductively contacting the contact tab 10. Specifically, the contact pin 11 has a front-side front leg or supporting leg 12 extending generally perpendicularly therefrom. The supporting leg 12 is seated against the inner housing 4. A base leg 14 also extends from the contact pin 11 generally parallel to the supporting front leg 12. An elastic spring leg 13 extends from the base leg 14, such that the spring leg 13 is disposed between the base leg 14 and the supporting leg 12, and spaced therefrom. A clamp slot is fashioned between this spring leg and the support leg 12. The width of this clamp slot is normally somewhat less than the thickness of the contact tab 10. The contact tab 10 causes the spring leg 13 to deflect, and the tab 10 is thus resiliently clamped between the two legs 12 and 13 and reliably contacted.

The spring leg 13 forms a contiguous U-shape with the non-free retainer leg 14 integrally attached to the contact pin 11. This gives the frontward contact portion of the contact pin a general G-shape from the legs 12, 13 and 14.

When securing the closure cap 9, the closure cap 9 is first pushed axially into the inner housing 4 so that the contact tab 10 strikes against the spring leg 13. The spring leg 13 is shaped to have a lead-in bevel 15 that receives the tab 10. The bevel 15 tapers under the fixed supporting leg 12. The contact cap 9 is then twisted axially, moving the tab 10 into the slot between legs 12 and 13. Sliding along the bevel 15, the contact tab 10 is thrust smoothly between the supporting leg 12 and the spring leg 13 when the closure cap 9 is subsequently turned in the fashion of a bayonet closure. The spring leg 13 resiliently biases against the tab 10, forming a conductive contact. The contact pin 11 is preferably narrowed in the section between the base leg 14 and support leg 12. This provides space for lengthening the spring leg 13, improving its spring characteristics.

The contact pin 11 is fixed at the inner housing 4 with two retainer noses 16. After plugging into the outer housing 3, the contact pin 11 is held with positive lock in the holder 1 with the cooperating contact.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed:

1. A holder for an electrical fuse, the fuse being cylindrical and having opposite conductive end caps, said holder comprising:

a tubular housing within which said fuse generally resides, the housing having a front end and a back end;

a closure cap securable to the front side of the housing, the closure cap having an inner metal cap with a radially extending contact tab;

a compression spring disposed within the housing at the back end thereof, the spring contacting a conductive end cap of the fuse to bias an opposite conductive end cap of the fuse against the inner metal cap;

a first terminal pin in electrical contact with the spring, a portion of the first terminal pin extending from the housing; and a second terminal pin disposed in the housing, the second terminal pin having:

a terminal portion extending from the back end of the housing; and a contact portion proximal to the closure cap, the contact portion including an elongated base, a cantilevered front leg extending from a first end of said base and overlying said base, and a cantilevered spring leg extending from a second end of said base, said spring leg extending intermediately between said front leg and said base, said spring leg overlying said base, a clamp slot being defined between said front leg and said spring leg to receive said contact tab and form an electrical contact connection therewith.

2. The holder according to claim 1, wherein the spring leg is tapered to form a lead-in bevel for receiving the contact tab between the spring leg and the front leg.

3. The holder according to claim 1, wherein the second terminal pin is narrowed to approximately one-half thickness in a region between said base and said front leg.

* * * * *